US007032763B1

(12) United States Patent
Zakula, Sr. et al.

(10) Patent No.: US 7,032,763 B1
(45) Date of Patent: Apr. 25, 2006

(54) SYSTEM AND METHOD FOR AUTOMATICALLY GUIDING A GANTRY CRANE

(75) Inventors: Daniel Brian Zakula, Sr., Mokena, IL (US); Harvey E. Schmidt, Flossmoor, IL (US)

(73) Assignee: Mi-Jack Products, Inc., Hazel Crest, IL (US)

( * ) Notice: Subject to any disclaimer, the term of this patent is extended or adjusted under 35 U.S.C. 154(b) by 0 days.

(21) Appl. No.: 10/298,487

(22) Filed: Nov. 18, 2002

(51) Int. Cl.
*B66C 19/00* (2006.01)

(52) U.S. Cl. ..... 212/344; 212/270; 701/41; 701/44

(58) Field of Classification Search ..... 212/270, 212/344; 701/41, 44, 215, 2
See application file for complete search history.

(56) References Cited

U.S. PATENT DOCUMENTS

| | | | | |
|---|---|---|---|---|
| 4,427,623 | A * | 1/1984 | Howard et al. | 376/263 |
| 5,144,317 | A * | 9/1992 | Duddek et al. | 342/357.11 |
| 5,512,902 | A | 4/1996 | Guthrie et al. | |
| 5,686,924 | A * | 11/1997 | Trimble et al. | 342/357.09 |
| 5,923,270 | A | 7/1999 | Sampo et al. | |
| 6,266,008 | B1 | 7/2001 | Huston et al. | |
| 6,549,835 | B1 * | 4/2003 | Deguchi et al. | 701/41 |
| 6,577,921 | B1 | 6/2003 | Carson | |
| 6,668,157 | B1 * | 12/2003 | Takeda et al. | 455/11.1 |
| 6,671,600 | B1 * | 12/2003 | Hintzy | 701/50 |
| 2002/0046142 | A1 | 4/2002 | Ishikura | |
| 2002/0070891 | A1 | 6/2002 | Houston et al. | |

FOREIGN PATENT DOCUMENTS

| | | | |
|---|---|---|---|
| EP | 0077085 | * | 4/1983 |
| JP | 2001-240372 | * | 9/2001 |
| WO | 98/34127 | * | 8/1998 |

* cited by examiner

*Primary Examiner*—Thomas J. Brahan
(74) *Attorney, Agent, or Firm*—Gardner Carton & Douglas LLP

(57) ABSTRACT

An automatic guidance system and method are provided for a gantry crane to permit accurate tracking along a path, including a curved path. The position of the crane is determined from two spaced apart GPS receivers fixed to the crane. A guidance controller determines a plurality of error measurements from respective front, center and rear points of the crane relative to a current tracking line, which is a line tangent to the path at a current position of crane. In an embodiment, the system includes a base station that can be used to transmit data to the crane to specify a particular destination location of the drive path, or to transmit data representing the drive path itself.

30 Claims, 8 Drawing Sheets

SYSTEM AND METHOD FOR AUTOMATICALLY GUIDING A GANTRY CRANE

FIELD OF THE INVENTION

This invention generally relates to gantry cranes and more particularly relates to a system and method for automatically guiding a gantry crane.

BACKGROUND OF THE INVENTION

Gantry cranes are generally known for lifting and handling shipping containers and trailers. Such cranes are commonly equipped with wheels and rubber tires for manuvering on an asphalt surface of a shipyard, railyard or other intermodal facility. A mobile crane equipped with rubber tires is commonly referred to as an RTG (rubber tired gantry).

The Global Positioning System (GPS) is widely used for determining positions on the earth. As is known, the GPS includes a plurality of orbiting satellites that send encoded signals. By triangulating the signals of multiple satellites a GPS receiver can determine an XYZ position relative to the earth.

Conventional gantry cranes are manually driven by a human operator who occupies a cab of the crane. It has been desirable to provide a guidance system for a crane that enables the crane to automatically drive to a designated point, for example to the position of a container to be lifted. Although some crane guidance systems are known, including guidance systems that utilize GPS, an improved guidance system is needed to permit accurate automatic steering tracking as the crane travels along a curved path.

BRIEF SUMMARY OF THE INVENTION

The invention provides an automatic guidance system and method for a land traveling vehicle, such as a gantry crane, wherein the method includes steps for determining tracking errors and then adjusting steering angles of the wheels based upon the combination of errors within certain parameters to maintain travel along a desired path within a desired level of accuracy. In an embodiment, for example, a method is provided for guiding a land traveling vehicle from a remote land station, the method including the steps of: defining a tracking line representing a desired travel direction at a current point along a desired land travel path, the tracking line intersecting a vehicle centerpoint; receiving signals from GPS satellites using a first GPS antenna fixed at a first position on the vehicle; receiving signals from GPS satellites using a second GPS antenna fixed at a second position on the vehicle that is spaced from the first GPS antenna in a horizontal direction; detecting a position of the first GPS antenna; detecting a position of the second GPS antenna; calculating a vehicle centerline that extends in a front-rear direction through a center of the vehicle, the vehicle centerline having a fixed relationship relative to vehicle and the first and second GPS antennae; determining a rotational error as an angular difference between the vehicle centerline and the tracking line; determining a front crosstrack error as a distance between the vehicle centerline and the tracking line at a reference distance forward of a front axle line that intersects the rotational axes of the front wheels; determining a rear crosstrack error as a distance between the vehicle centerline and the tracking line at a reference distance forward of a rear axle line that intersects the rotational axes of the rear wheels; determining a center crosstrack error as a distance between the vehicle centerpoint and the tracking line.

Additionally, an embodiment of the method includes steps for steering wheels of the vehicle to minimize the tracking errors and to provide correct steering angles for the steerable wheels of the crane. The crane steering control system correctively maintains proper steering angles of the steerable wheels of the crane during automatic guidance operation of the crane. Advantageously, by maintaining precise steering angles, the steering control system eliminates undesired structural loading of the crane due to actual wheel angle errors. In a closed loop fashion, the steering control system receives feedback from wheel angle sensors and provides output signals to the steering actuators for the steerable wheels. The control system operates to adjust the steerable wheels to respectively desired angles for the steerable wheels on the inside and outside and outside of a turn or curve. Moreover, the control system operates to constantly maintain appropriate inside and outside steerable wheel angles while the steerable wheels move from one set of angles to another as determined by the guidance controller to minimize the tracking error.

In an embodiment, the guidance controller determines the tracking errors FXTE, RXTE, CXTE, and RE. A steering controller applies a steering algorithm to determine the required inside steerable wheel angles as a function of the outside steerable wheel angles to minimize these errors.

An advantage of the present invention is that it provides an improved system and method for automatically guiding a gantry crane.

Another advantage of the present invention is that it provides a system and method for automatically guiding a gantry crane capable of determining both translational and rotational error of a vehicle relative to a desired guide path. As a result, the present invention advantageously provides accurate tracking along a curved path.

A further advantage of the present invention is that it provides a system and method for automatically guiding a gantry crane that allows the crane to travel at a higher rate of speed.

Still another advantage of the present invention is that it provides a system and method for automatically guiding a gantry crane that reduces the travel time between land points, thereby increasing loading efficiency.

These and other advantages of the invention, as well as additional inventive features, will be apparent from the description of the invention provided herein.

DETAILED DESCRIPTION OF THE INVENTION

Figure 1:
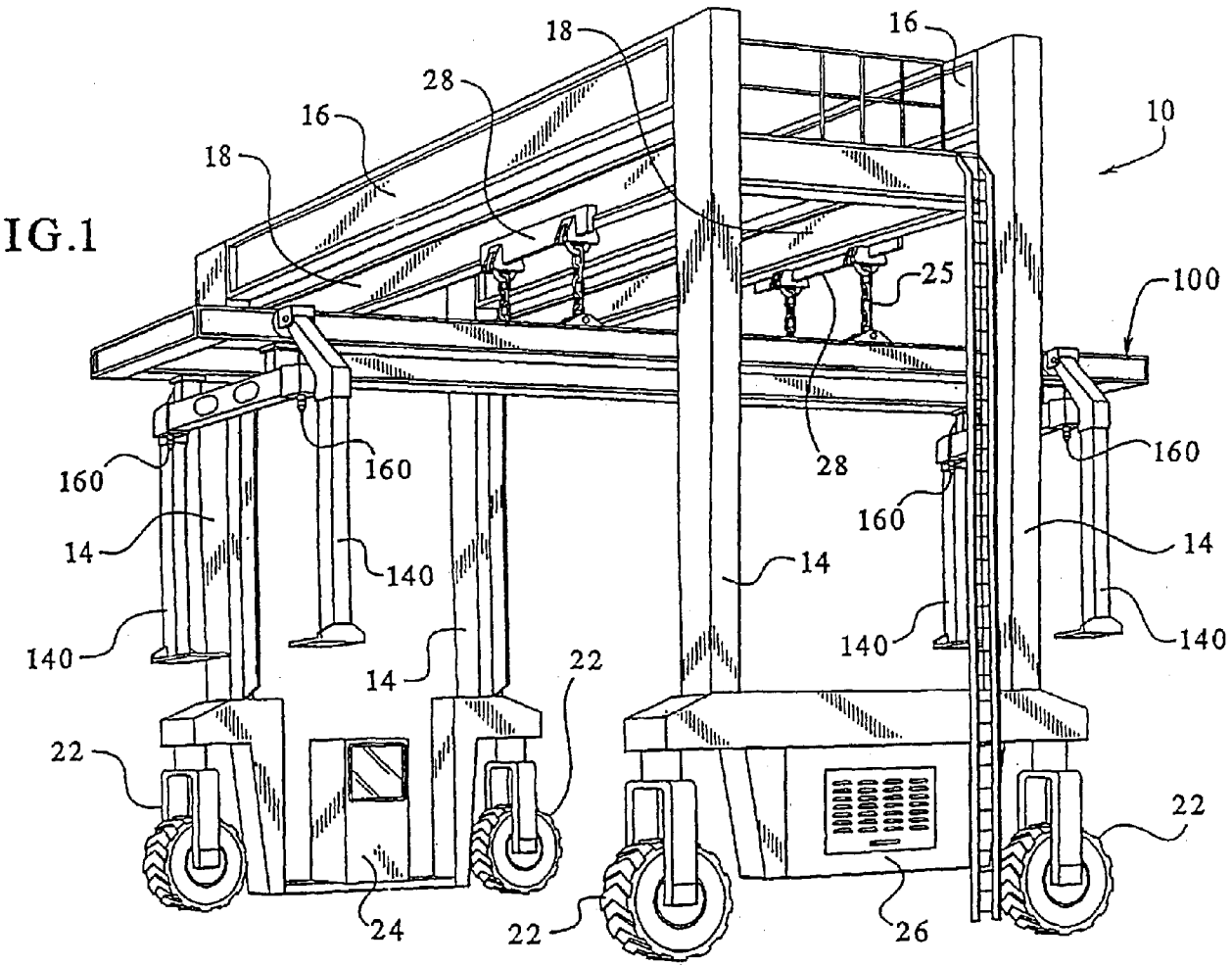
FIG. 1 is a perspective view of a gantry crane.
Figure 2:
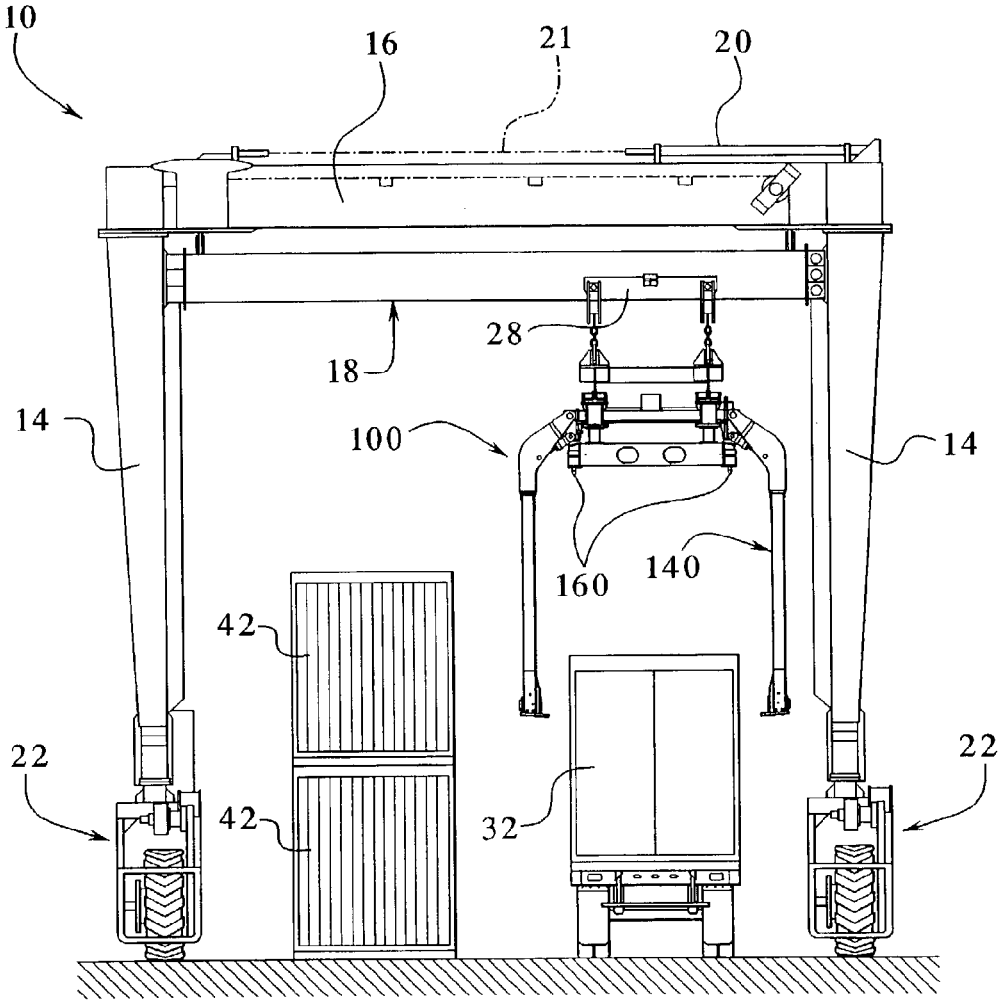
FIG. 2 is a rear elevation of the crane of FIG. 1, the crane positioned over objects to be lifted.

Now referring to the Figures, wherein like numerals designate like components, an exemplary straddle-type crane such as gantry crane 10 is shown generally in FIGS. 1 and 2. Those skilled in the art will recognize that the present invention will have uses in guiding various mobile structures and vehicles, although the invention is particularly useful for gantry cranes or straddle cranes or for vehicles adapted for carrying various loads including, for example, containers. An exemplary embodiment of the invention shall be described herein accordingly. Although various crane structures are possible, the illustrated embodiment of the gantry crane 10 includes four vertically upright columns 14 arranged in front and rear pairs. Upper support beams 16 are mounted to extend between upper ends of the respective front and rear pairs of the columns 16. The illustrated gantry crane 10 includes a plurality of wheel assemblies 22 having rubber tires for mobility on a road surface, such as asphalt, however, the crane 10 could otherwise be adapted rail or stationary use. Each of the wheel assemblies can be pivoted to adjust a respective steering angle.

Referring to FIGS. 1 and 2, to provide vertical lifting capability, the crane 10 includes a pair of vertically movable stabilizer beams 18. Each of the stabilizer beams 18 is adapted to move vertically up or down relative to columns 14 for lifting loads. Each of the stabilizer beams 18 is movably disposed horizontally between a pair of the columns 14 and has a pair of oppositely directed ends, each of the ends spaced from an inner side of one of the columns 14.

In an embodiment, the invention may be used on a container-handling vehicle configured for carrying loads such as containers or trailers, and in an embodiment the illustrated crane 10 may be adapted as such a container-handling vehicle. Various mechanisms may be mounted to beams of the crane, such as the stabilizer beams 18, to grip or carry a load to be lifted. For example, in the illustrated embodiment, each of the stabilizer beams 18 supports a trolley 28 adapted to traverse the length of the stabilizer beam. Each of the trolleys 28 is movably mounted to a lower horizontal portion of the elongate portion of the stabilizer beam 18. A grappler 100 is suspended from the trolleys 28 for grasping, latching or otherwise securing an object to be moved, for example a trailer 32 (FIG. 3) or shipping container 42. As will be recognized by those skilled in the art, the stabilizer beams 18 of the crane 10 can be used to support various types of grapplers as appropriate to lift particular types of objects. In an intermodal shipping facility, it is desirable that the grappler 10 can lift various types of loads. The exemplary grappler 100 includes pivotable arms 140 for lifting a trailer 32 (FIG. 2), and the grappler also includes from corner mounted twistlocks 160 which are engageable into standard brackets of a standard shipping container 42 (FIG. 2).

To vertically drive the stabilizer beam 18, the crane 10 includes an actuator 20 mounted to the upper support beam 16 as illustrated in FIG. 2. The actuator 20 moves a chain or cable 21 that is operably linked to the stabilizer beam 18 so that retracting or extending the actuator 20 is effective to respectively raise and lower the stabilizer beam 18 with respect to the columns 14. It will be apparent that alternative structures for vertically moving stabilizer beam 18 are readily available and could be employed with the present invention. For example, other known cranes include a rotatable drum that feeds or retracts a wire rope effective to raise or lower the stabilizer beam 18, or the wire rope can be directly attached to the grappler to raise and lower the load.

The crane 10 further includes a cab 24 (FIGS. 1 and 2) containing controls by which an operator can drive the crane and manipulate the movement of the stabilizer beams 18 and components of the grappler 100. The crane components are powered by a hydraulic pump driven by an internal combustion engine housed within an enclosure 26 shown in FIG. 1. As will be recognized by those skilled in the art, components of the crane could be driven by other types of actuators. For example, the crane could include a generator that provides power to electric motors coupled to drive components of the crane.

Figure 3:
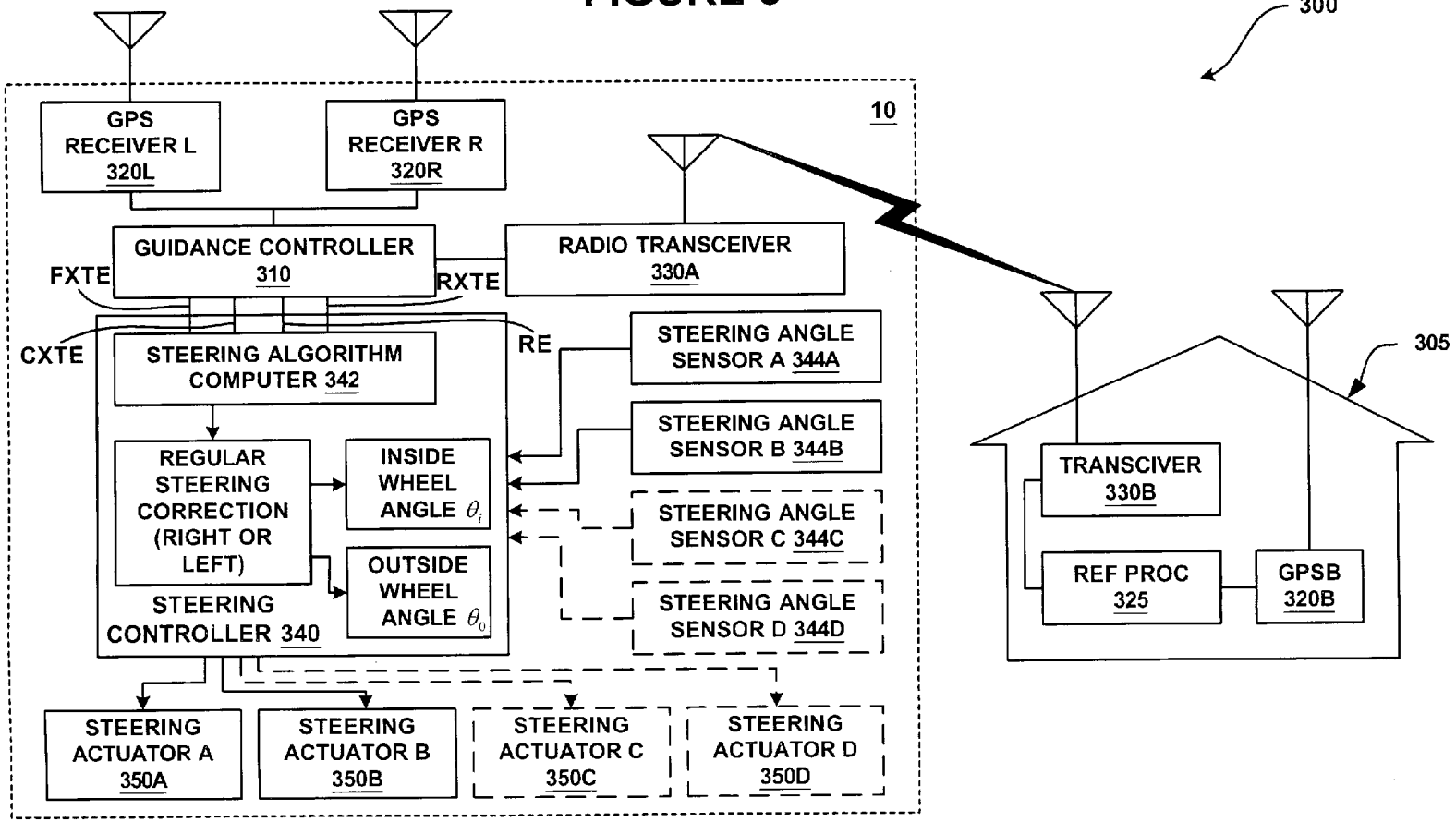
FIG. 3 is a schematic diagram of a system for automatically guiding the crane having features in accordance with teachings of the present invention.
Figure 4:
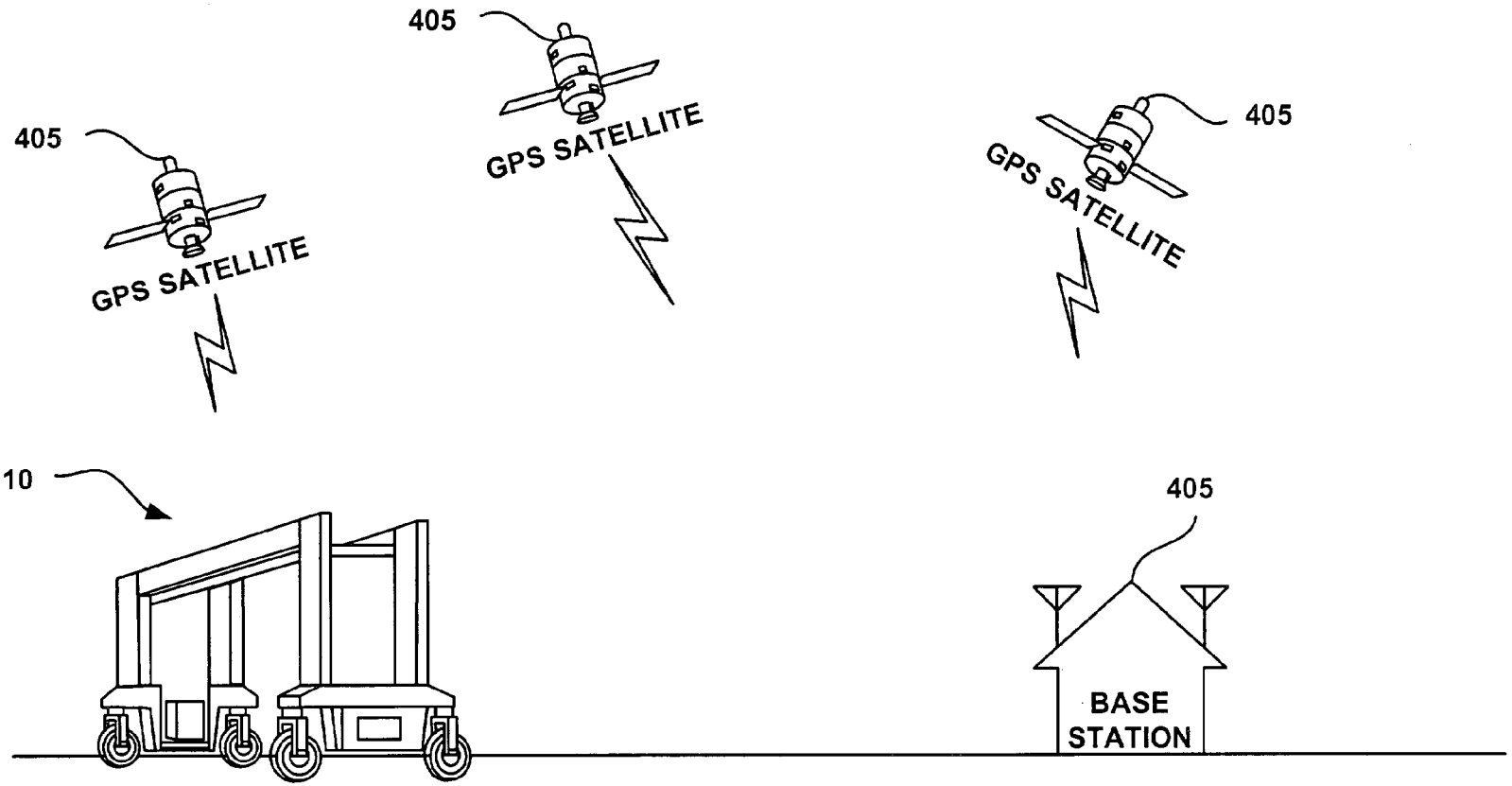
FIG. 4 is a schematic view of the gantry crane of FIG. 1 on land with relation to a ground station and a plurality of orbiting global positioning satellites.

According to an aspect of the invention, a control system 300 is provided for automatically guiding the crane. With reference to FIG. 3, the control system 300 includes components on the crane 10, particularly a guidance controller 310, a plurality of GPS receivers 320R, 320L, and a radio transceiver 330A. The guidance controller provides output signals to control each of the respective steering actuators 350A–D. Also, the control system 300 includes components at a fixed base station 305, particularly a base GPS receiver 320B, a reference processor 325 and a RF transceiver 330B. As illustrated in FIG. 4, the base station 305 is located at a known, fixed position, e.g., at a building, while the gantry crane 10 is remotely maneuverable relative to the base station. Although the base station 305 is fixed during use, those skilled in the art will recognize that the base station 305 could be a portable unit or located at a parked trailer or van. The base station 305 can operate with multiple mobile cranes 10 in the vicinity.

Figure 5:
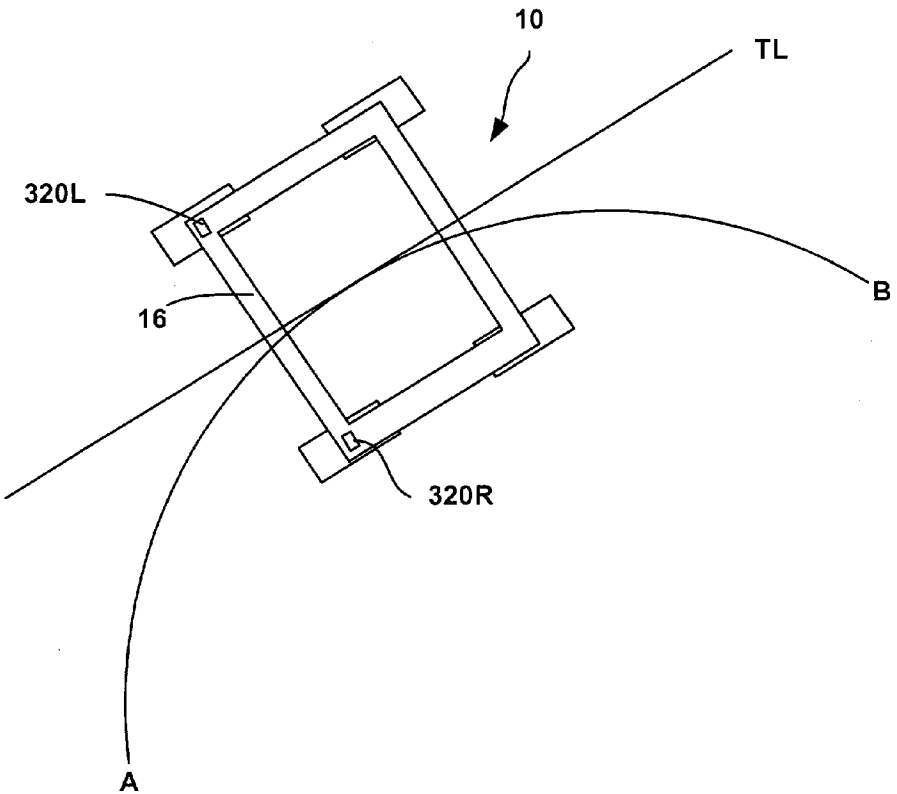
FIG. 5 is a schematic plan view of the gantry crane traveling along a desired drive path, a tracking line extending tangentially through a current point of the crane along the drive path.

As will be explained below, the control system is generally operates to steer the gantry crane 10 utilizing GPS signals from GPS satellites 405, as illustrated in FIG. 4. Using the GPS signals, the control system is 300 (FIG. 3) operates to steer the crane along a desired path AB as shown in FIG. 5. An advantage of the present invention is that it facilitates accurate guidance of the crane 10 even in a situation where the desired path AB is curved.

Figure 6:
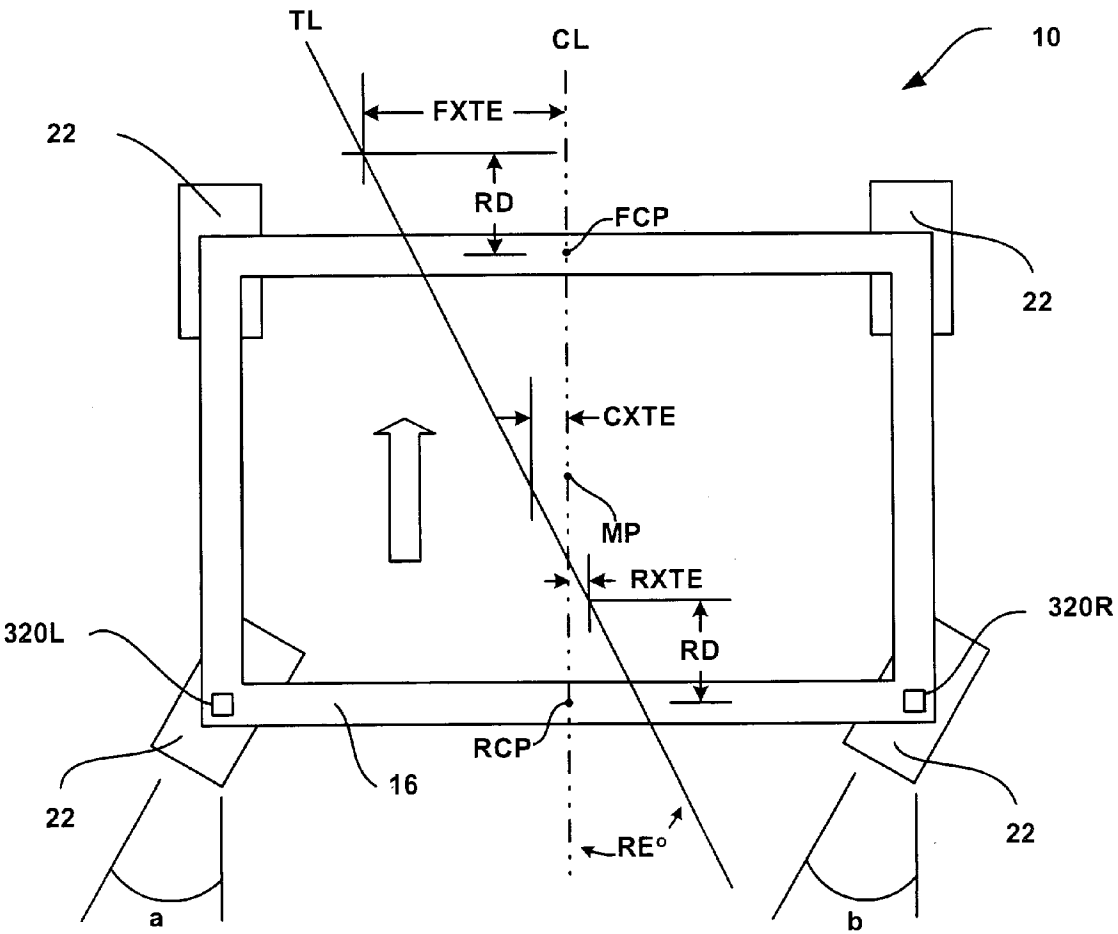
FIG. 6 is a schematic plan view of the gantry crane with respect to the line.

Each of the GPS receivers 320R, 320L includes a respective GPS antenna mounted to the crane spaced from each other. Preferably, the GPS antennae are mounted at first and second positions of the crane, atop opposite ends the support beam 16 for optimal separation in order to increase positioning precision, as shown in FIGS. 5 and 6. The antennae of the GPS receivers are exposed skyward for communicating with the GPS satellites 405, as illustrated in FIG. 4. Currently, 24 GPS satellites are in orbit. The element numbers 320R and 320L are used herein to represent respective right and left GPS receivers and associated antennae in combination. It will be recognized, however, that the antennae could be mounted at the positions 320R, 320L and wired to other components of the GPS receiver which are physically located at a different part of the crane, such as in the cab. By providing at least the two GPS receivers 320L and 320R on the crane 10, the guidance controller 310 can determine an orientation of the crane.

The GPS receivers 320R, 320L, and 320B (FIG. 3) are adapted to receive encoded GPS signals from standard GPS satellites 405 (FIG. 4), which are at various orbital positions around the earth, as will be recognized by those of ordinary skill in the art. Based on known triangulation techniques, each of the GPS receivers 320R, 320L, and 320B is capable of determining a current position (e.g., longitude, latitude, altitude) of an antennae of the associated GPS receiver.

The control system 300 of FIG. 3 can be made up of various commercially available components. For example, it has been found that NOVATEL model OEM4-L1/L2 is suitable for use as GPS receivers 320R, 320L and 320B, NOVATEL model GPS-600 provides suitable antennae and cables for use with the GPS receivers, FREEWAVE model DGR24AS is suitable for each of the radio transceiver units 330A, 330B located at the crane 10 and base station 305, respectively, FREEWAVE model EAN2405WC is suitable for an antenna and cables for each of the radio transceiver units 330A, 330B.

The guidance controller 310 generally coordinates all of the GPS data, calculates various error values, as will be described herein. The control system 300 further includes a steering controller 340 which receives the wheel position signals from steering angle sensors 344A–D, as well as errors signals FXTE, CXTE, RXTE, and CE from the guidance controller. The steering controller 340 determines appropriate steering angles based upon the desired path and error values, and provides control signals for adjusting steering actuators 350A–D. It should be noted that the steering controller 340 would provide control signals to only two steering actuators 350A and 350B in an embodiment wherein the crane 10 is configured for two-wheel steering during a driving mode. In an embodiment wherein the crane is adapted for four-wheel steering during drive mode, the steering controller 340 controls the steering actuators 350C and 350D in addition to actuators 350A and 350B. In an embodiment, the guidance controller 310 can receive input for determining the desired path AB (FIG. 5). The reference controller 325 generally coordinates the base station GPS data and, in an embodiment, receives input data for use in generating or identifying some or all the desired path AB (FIG. 5), such as a desired destination point. The guidance controller 310 and reference processor 325 each include an appropriate computer or circuit having a processor, power supply, storage, operating system, input device and display, as will be known to those skilled in the art.

The base GPS receiver 320B enables the position of each of the mobile GPS receivers 320R, 320L to be determined with greater precision. The guidance control system 300 is operable to calculate a correction vector representing a difference between a stored, known position of the GPS receiver 320 and the GPS position as currently measured by the GPS receiver 320B. In an embodiment, the guidance controller 310 calculates the correction vector based upon the stored known value in comparison to GPS data from the base GPS receiver 320B as transmitted from radio transceiver 330B to the radio transceiver 330A of the crane 10. In another embodiment, the reference processor 325 calculates the correction vector which is transmitted from the radio transceiver 330B at the base to the radio transceiver 330A of the crane 10 and forwarded to the guidance controller 310. The correction vector represents the difference between the known and measured positions of the base GPS receiver 320B. It is assumed that a similar difference between measured and actual positions currently affects the mobile GPS receivers 320R, 320L, and accordingly, the correction vector is used to adjust the position data as measured by the mobile GPS receivers 320R, 320L for improved precision.

An aspect of the present invention is a method for guiding the crane to travel along a desired path which may be curved as will be described with reference to FIGS. 5–7. The method includes determining various "errors" relative to the desired path and orientation. For example, with reference to FIG. 6, various errors are illustrated including a center crosstrack error CXTE, a front crosstrack error FXTE, a rear crosstrack error RXTE, an a rotational error RE. Still referring to FIG. 6, the error values CXTE, FXTE, RXTE and RE are determined based on relative positions of a centerline CL that passes centrally through the crane 10 and a tracking line TL. The centerline CL passes through a front center point FCP, a centerpoint or midpoint MP, and a rear center point RCP. The tracking line TL is a line that defines a desired current position and orientation of the centerline CL. If the crane 10 were tracking perfectly along the desired path, the lines CL and TL would be the same. In a situation where the desired path AB is curved, as illustrated in FIG. 5, the line TL is a tangent of the curve. Referring back to FIG. 6, the center crosstrack error CXTE is a lateral distance of the center point MP from the tracking line TL. The front crosstrack error FXTE represents a lateral distance between the center line CL and the tracking line TL at a reference distance RD forward of axles of the front wheels 22. The rear crosstrack error RXTE represents a lateral distance between the center line CL and the tracking line TL at the reference distance RD forward of axles of the rear wheel assemblies 22. The rotational error RE represents an angular difference between the centerline CL and the tracking line TL.

Figure 7:
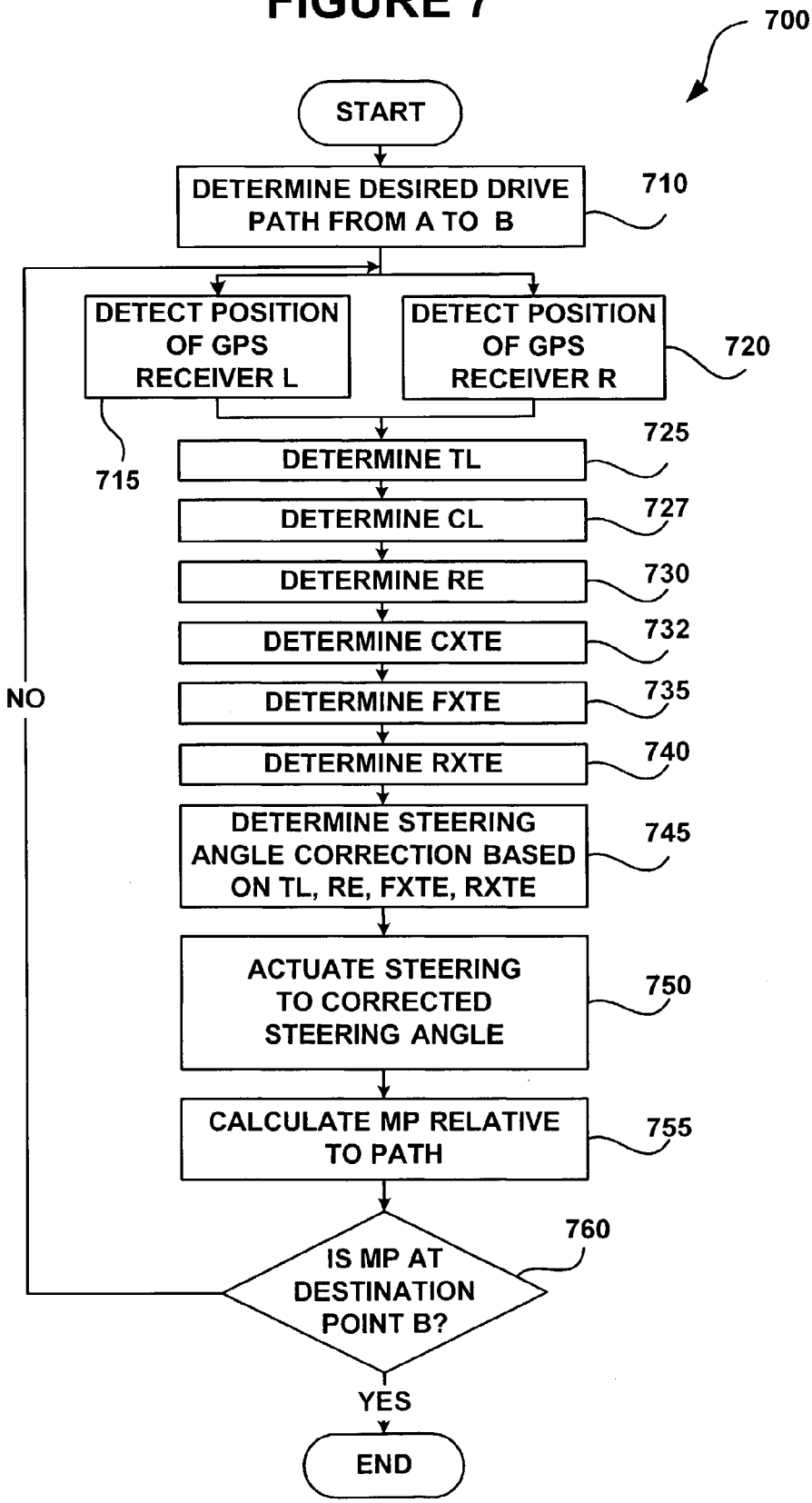
FIG. 7 is a schematic flow diagram of a method for guiding the gantry crane.

Referring to FIG. 7, a control method 700 is provided for determining positioning error relative to a desired drive path and for automatically guiding the crane.

The desired drive path AB extends from a starting position A to a desired destination position B, as illustrated in FIG. 5. The destination position B represents, for example, a target container to be retrieved or a target delivery location of a container carried by the crane. In an embodiment, the destination position may be entered by an operator or computer at the base station and then transmitted from the base station to the controller at the crane. Alternatively, the crane operator can input the destination position data from an onboard input device to the controller, or the controller can be programmed to execute a series of load handling missions relating to preset destination locations. In an embodiment, the starting position A can be assumed to be the current position.

As indicated at step 710 of FIG. 7, based on appropriate input, a path AB from starting point A to destination point B is determined. Various means are useful for determining the path AB. In an embodiment, the controller determines that the current crane position is the starting point of the desired path AB.

A straight path is suitable only in some situations, such as when the crane can perform multiple container handling operations along a straight lane, however, other situations arise wherein the required path is not straight. In a shipping yard, the quickest and/or most efficient drive path may be along a curved path, such as the path AB illustrated in FIG. 5. Additionally, gantry cranes are large, heavy, and cumbersome to maneuver, particularly when carrying a heavy load that can cause the grappler to sway. A path of optimal efficiency, therefore, may be along a path that avoids sharp turns, to the extent possible, in favor of wider, curved turns.

The path AB is preferably determined in a manner so that the crane 10 avoids obstacles and remains in appropriate driving lanes having appropriate driving surfaces, such as asphalt or concrete pads. In an embodiment, the path AB is automatically generated by an algorithm based upon various input data, such as the current position A and the destination B, and the guidance controller 310 may optionally determine the path in conjunction with predetermined map data containing approved lane boundaries between stacks of containers and obstacles. In an embodiment, the path AB may be determined based upon an input of several plotted points along the desired path. In another embodiment, some or all of the path AB can be programmed by recording GPS positions during manual crane movement on a desired route. The path AB to the destination position AB may include one or more curve.

In an embodiment, the desired path AB may also be determined based upon a starting orientation of the crane 10 and a needed destination orientation. A particular destination orientation may be necessary in order for the crane 10 to straddle over a target container at the destination B and/or to straddle obstacles as necessary to drive to the destination position B. The orientation information for the crane 10 and destination is factored as parameters in determining the path AB. For example, most grapplers 100 must generally be aligned with the object 32, 42 (FIG. 2) to be lifted. Additionally, cranes having two-wheel steering must depart the starting position A and approach the destination position B along front-rear axis of the crane maneuver the crane to straddle the target container at the destination. A crane having four wheel steering offers greater drive path flexibility, as the crane can also maneuver sideways.

Referring back to FIG. 7, after the desired path from A to B is determined at step 710, the drive wheels of the crane are actuated to drive the crane along the path. As the crane drives, a current position of the crane is detected and periodically updated. More specifically, as indicated at steps 715 and 720, the guidance controller detects the positions of the right and left GPS units, 320R, 320L (FIGS. 3, 5 and 6), respectively. In particular, the position signals of the GPS receivers 320R, 320L continue to send GPS data to the guidance controller 310 (FIG. 3) as the crane is in motion. At the same time, the GPS 320B at the base station 305 also continues to transmit data to the controller 310. The controller receives updated GPS data at a frequency of, for example, 10 times per second. The controller 310 continually determines the correction vector and adjusts the positions measured by the GPS receivers 320R, 320L accordingly. Alternatively, the correction vector can be determined by the reference processor 325 at the base station 305 and transmitted to the guidance controller 310.

Referring to step 725 in FIG. 7, for each incremental period at which new GPS position data is received by the controller, the controller determines the tracking line TL. As shown in FIG. 5, the tracking line TL is a tangent of the path AB and represents a desired travel direction at a current point along a desired land travel path.

As indicated at step 727 of FIG. 7, the vehicle centerline CL is determined. The vehicle centerline CL extends in a front-rear direction through the vehicle centerpoint MP, as shown in FIG. 6. The centerline CL has a fixed relationship relative to vehicle 10 and the antennae of the first and second GPS receivers 320R, 320L.

As indicated at step 730 of the method of FIG. 7, the rotational error RE is determined as an angular difference between the vehicle centerline CL and the tracking line TL. Rotation error RE can occur when the front and rear crosstrack errors are not equal. RE is an angular value. The rotational error RE is zero when the centerline of the crane is parallel to the tracking line.

As indicated at step 732 of FIG. 7, the center crosstrack error CXTE is determined at step 732. To determine the center crosstrack error CXTE, the controller calculates a lateral distance between the vehicle center point MP and the tracking line TL, as illustrated in FIG. 6.

A front crosstrack error FXTE is determined at step 735 of FIG. 7. To determine the front crosstrack error FXTE, the controller calculates a lateral distance between the vehicle centerline CL and the tracking line TL at the reference distance RD forward (relative to the general direction of travel) of axles of the front wheel assemblies 22, as illustrated in FIG. 6.

A rear crosstrack error RXTE is determined at step 740 of FIG. 7. To determine the rear crosstrack error RXTE, the controller calculates a lateral distance between the vehicle centerline CL and the tracking line TL at the reference distance RD forward (relative to the general direction of travel) of axles of the rear wheels assemblies 22, as illustrated in FIG. 6.

Advantageously, the use of multiple GPS receivers 320R, 320L on the crane 10 permit the calculation of the CL and any or all of the error values RE, CXTE, RXTE and FXTE. The multiple GPS receivers 320R, 320L allow the orientation of the crane to be calculated and thereby enable guidance to maintain steering orientation of the crane along a curved path. By monitoring error values such as CXTE, RXTE and FXTE at multiple points of the crane relative to the desired tracking line TL and path AB, the present invention facilitates highly accurate tracking control.

Preferably, the guidance controller 310, located on board the crane 10, as illustrated in FIG. 3 performs steps 725–745. The controller 310 is preprogrammed with information concerning dimensions of the crane (e.g., wheelbase, tracking width) and relative positions of the GPS receivers 320R, 320L, and needed to calculate CL, RE, CXTE, RXTE and FXTE relative to the tracking line TL.

Also, the controller 310 is programmed with predetermined control parameters, for example, the preferred reference distance RD based upon a particular speed. The controller can determine the current RD based upon an algorithm or a table relating a particular RD value corresponding to the current velocity. The reference distance RD can be any distance appropriate to effect the desired control accuracy. When the control system is used for guiding a gantry crane 10, it has been found that suitable results are achieved when the reference distance RD is about 15 feet when the crane 10 is traveling at maximum speed, which is typically about 4 miles per hour. The reference distance RD decreases proportionally to crane speed, so that the reference distance RD is zero (directly on an axle line between front or rear axles) when the crane is at a minimum speed. Of course, the crane is equipped with appropriate sensors, e.g., speed sensors, to provide necessary signals to the controller as needed.

The values for the errors CXTE, FXTF, and RXTE may be in any appropriate units. For example, in an embodiment, the controller 310 calculates the errors CXTE, FXTE, and RXTE in inches. Moreover, in an embodiment, the error value is negative when the error is left of the centerline CL, and the error value is positive when the error is right of the centerline CL.

It should be noted that the order of steps 730, 732, 735, and 740 is not necessary, and the values RE, CXTE, FXTE, RXTE can be calculated in any order or concurrently. Regardless of order of calculation, when the error values RE, CXTE, FXTE, RXTE, and have been determined at steps 730, 732, 735, and 740, respectively, an appropriate steering correction is calculated based upon parameters including these error values, as indicated at step 745.

In an embodiment, determining of the steering angle correction at step 745 may also consider one or more other parameters, such as velocity, a proximity to a limit of an authorized travel zone, a proximity to an obstacle, or another appropriate parameter. The steering controller applies an appropriate algorithm to the parameters, determining a desired current steering angle of the steerable wheels. The steering algorithm is adapted to the particular steering configuration of the crane, such as front wheel steering, rear wheel steering, or all wheel steering, and includes the crane geometry, such as tracking width TW and wheel. Accordingly, the steering control system is adapted to steer the steerable wheels in the particular two or four wheel steering configuration. Additionally, the steering algorithm accounts for crane geometry, such as tracking width and wheelbase.

In an embodiment, step 745 operates to steer wheels of the vehicle to minimize the tracking errors and to provide correct steering angles for the steerable wheels of the crane. For example, a suitable steering controller is described in U.S. Pat. No. 6,206,127, incorporated herein by reference in its entirety. The crane steering control system correctively maintains proper steering angles of the steerable wheels of the crane during automatic guidance operation of the crane. Advantageously, by maintaining precise steering angles, the steering controller eliminates undesired structural loading of the crane due to actual wheel angle errors. With reference to FIG. 3, the steering controller 340 receives feedback (preferably in a closed-loop fashion) from wheel angle sensors 344A–D and provides output signals to the steering actuators 350A–D for the steerable wheels. Together, the guidance controller 310 and steering controller 340 of the control system 300 operate to adjust the steerable wheels to respectively desired angles for the steerable wheels on the inside and outside and outside of a turn or curve. Moreover, the steering control system 300 operates to constantly maintain appropriate inside and outside steerable wheel angles while the steerable wheels move from one set of angles to another as determined by the guidance controller 310 to minimize the tracking error.

Figure 8:
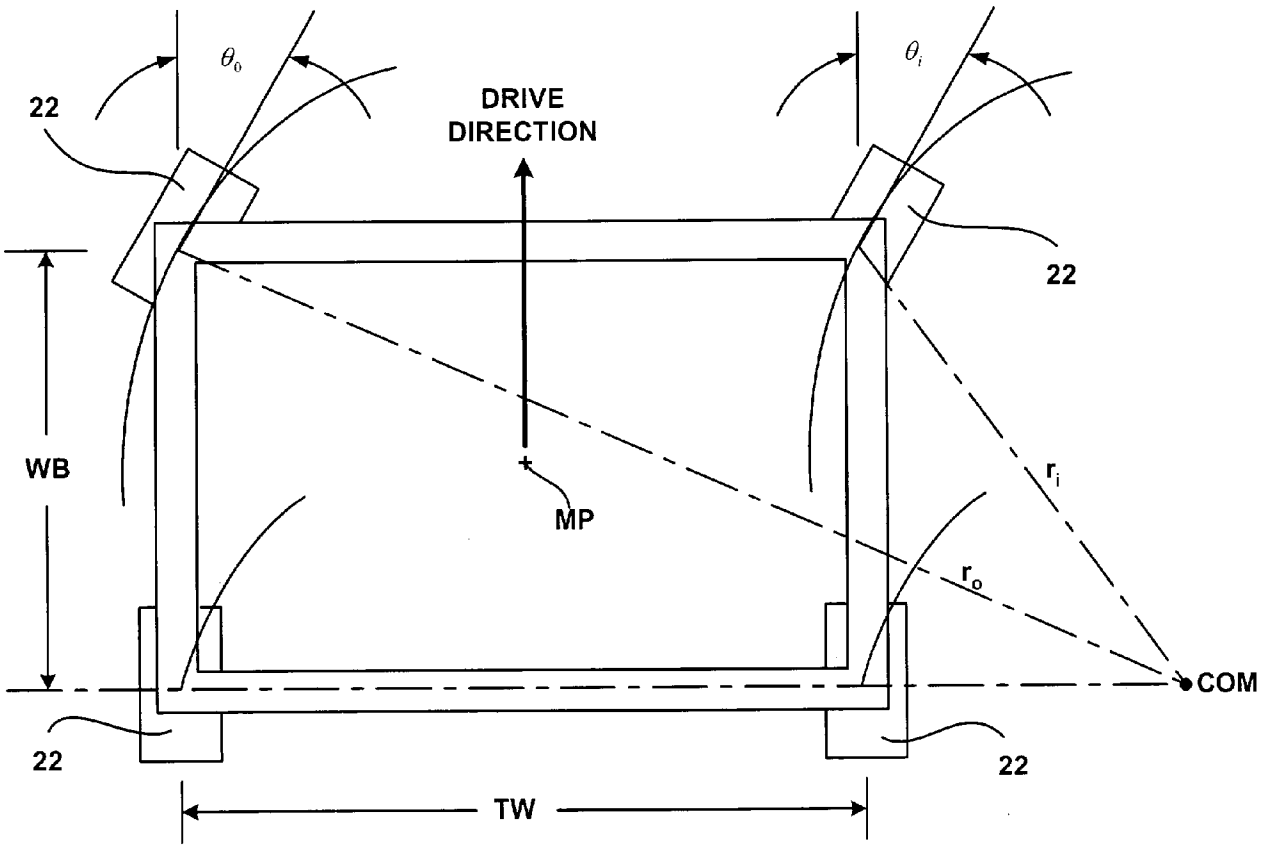
FIG. 8 is a schematic plan view of the gantry crane illustrating geometric variables considered by the steering control system and wheel turn radii meeting at a common point during desired steering control.

FIG. 8 illustrates general geometric dimensions and variables considered by the steering controller. The steerable wheels are steered according to Ackerman steering geometry, wherein all of the wheels have turning radii that intersect at a common point COM. With reference to FIG. 8, the inside and outside steerable wheels are steered at steering angles $\theta_i$ and $\theta_o$, respectively, such that the inside and outside wheels have turning radii $r_i$ and $r_o$ that intersect at a common point with turning radii of the remaining wheels. The inside wheel angle $\theta_i$ is always greater than the outside wheel angle. The outside angle $\theta_o$ function of the inside wheel angle $\theta_i$ and crane tracking width TW, wheelbase WB, and instantaneous turning radii $r_i$ and $r_o$, according to the following:

$$\mathrm{Tan}\theta_i = \frac{WB}{r_i} \tag{A}$$

$$\mathrm{Tan}\theta_o = \frac{WB}{r_i + TW} \tag{B}$$

$$r_i = \frac{WB}{\mathrm{Tan}\theta_i} = \frac{WB}{\mathrm{Tan}\theta_o} - TW \tag{C}$$

By manipulating equation C, the following relationship is established:

$$\mathrm{Tan}\theta_o = \frac{WB}{WB + TW} * \mathrm{Tan}\theta_i \tag{D}$$

Equation D represents the relationship between the outside angle $\theta_o$ and the inside angle $\theta_i$.

The steering algorithm of the steering controller defines the required steering correction (to steer either to the right or left) from the tracking errors FXTE, RXTE, CXTE, and RE, and determines the required inside angle. In the closed-loop steering system, the proper actuator signal is sent to an actuator to drive the appropriate wheel to the required inside angle. The instantaneous angular position $\theta_i$ of the inside steerable wheel, as measured by its angle sensor, determines the corresponding outside angle $\theta_o$, that is required from equation D above. A signal indicating steering angle $\theta_i$ of the inside wheel is applied to the relationship of equation D, resulting in a signal that actuates adjustment of the outside steerable wheel to steering angle $\theta_o$. The instantaneous difference between the inside and outside angles is also measured by the steer control system to maintain a minimum following error. The faster wheel is slowed down to allow the slower wheel to catch up to the required position to maintain an appropriate minimum following error or to eliminate it.

Based on the results of step 745, steering corrections are executed at step 750 by actuating the steering actuators 350A and 350B (FIG. 3) (alternatively all four steering actuators 350A–D) to move wheels of the crane to a desired current steering angle. The steering adjustment keeps each of the errors FXTE, CXTE, RXTE, and RE as close to zero as possible to keep the crane traveling generally along the path until the destination is reached. More specifically, at step 755, the position of the vehicle center point MP is determined and compared to the desired path AB. As indicated at step 760, if the center point MP is not at the same position as the destination point B (FIG. 5), the crane 10 has not yet reached its final position, and steps 715–760 are repeated at each incremental update of GPS data, e.g., each 1/10 second. If, at step 760, the center point MP is determined to match the destination point B and the rotational error RE is within a range of tolerance, the crane 10 has reached the destination and driving actuation is stopped. In an optional embodiment, the controller 310 (FIG. 3) can gradually slow down the drive speed of the vehicle 10 as the center point MP approaches a proximity of the destination point B.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Of course, variations of those preferred embodiments will become apparent to those of ordinary skill in the art upon reading the foregoing description. For example, the invention could be implemented using a position sensing means other than GPS technology, such as a ground based radio position detection system, infrared waves, sonar position sensors, or any appropriate device that is be recognized for use in position detection. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A method for guiding a land traveling straddle crane from a remote land station along a curved path, the method comprising the steps of:

providing at least two GPS receivers, each of the GPS receivers having an antenna mounted to the vehicle so that the antennae are spaced apart from each other;

defining a tracking line representing a desired travel direction at a current point along a desired land travel path that can include at least one curved portion, the tracking line intersecting a vehicle centerpoint;

receiving signals from GPS satellites using a first GPS antenna fixed at a first position on the crane;

receiving signals from GPS satellites using a second GPS antenna fixed at a second position on the crane that is spaced from the first GPS antenna in a horizontal direction;

detecting a position of the first GPS antenna;

detecting a position of the second GPS antenna;

determining a rotational error as an angular difference between a vehicle centerline and the tracking line, the vehicle centerline extending in a front-rear direction through a vehicle center, the vehicle centerline having a fixed relationship relative to vehicle and the first and second GPS antennae;

steering wheels of the crane to reduce the rotational error and to guide the crane along said land travel path.

2. The method of claim 1, further comprising:

determining a front crosstrack error as a distance between the vehicle centerline and the tracking line at a reference distance forward of a front axle line defined as a line that would serve as a common rotational axis of the front wheels when both front wheels are straight;

determining a rear crosstrack error as a distance between the vehicle centerline and the tracking line at a reference distance forward of a rear axle line defined as a line that would serve as a common rotational axis of the rear wheels when both rear wheels are straight; and determining a center crosstrack error as a distance between the vehicle centerline and the tracking line;

whereby said steering step also reduce at least one of said crosstrack errors.

3. The method of claim 2, further including determining said reference distances as function of vehicle speed.

4. The method of claim 3, whereby said reference distance varies proportionally to the speed.

5. The method of claim 1, further comprising the step of transmitting data representing the tracking line from a ground station to the crane.

6. The method of claim 1, further comprising:

measuring a fixed base position of a base GPS receiver;

providing a predetermined desired position of the crane; and calculating a correction vector that represents a difference between: (a) a current position as measured by the first and second GPS antennae relative to the fixed base position; and (b) the predetermined desired position relative to the fixed base position;

whereby the steering step further includes moving the crane by the correction vector.

7. The method of claim 1, wherein the desired travel path has a destination point where a container or other load is to be delivered.

8. The method of claim 1, wherein the desired travel path has a destination point where a container or other load is to be lifted.

9. A method for guiding a land traveling straddle crane from a remote land station, the method comprising the steps of:

providing at least two GPS receivers, each of the GPS receivers having an antenna mounted to the crane so that the antennae are spaced apart from each other;

determining a position of each of the antennae of the respective GPS receivers;

determining an orientation of the land traveling crane based upon the relative positions of the GPS receivers, and steering wheels of the crane with respect to the orientation to guide the crane along a desired land travel path that can include at least one curved portion.

10. A guided vehicle system comprising:

a road-traveling straddle crane having a rigid frame;

at least two GPS receivers, each of the receivers having an antenna mounted to the frame so that the antennae are spaced from each other; and a controller for processing position data from the two GPS receivers, the controller operable to determine an orientation of the crane based upon the relative positions of the two GPS receivers and to steer the straddle crane along a path that can include a curve portion.

11. The system of claim 10, further comprising:

a base station that is fixed relative to the ground;

a base GPS receiver having an antenna fixed to the base station;

means for determining a correction vector representing a difference between: (a) a current position as measured by the first and second GPS antennae relative to the fixed base position; and (b) the predetermined desired position relative to the fixed base position; and means for moving the crane by the correction vector.

12. The system of claim 10, further comprising a means for identifying a desired drive path.

13. The system of claim 10, further comprising a means for defining a tracking line representing a desired travel direction at a current point along a desired land travel path, the tracking line being tangent to the desired travel path at the current point, means for determining a rotational error as an angular difference between a vehicle centerline and the tracking line, the vehicle centerline extending in a front-rear direction relative to through a vehicle center, the vehicle centerline having a fixed relationship relative to vehicle and the first and second GPS antennae; means for determining a front crosstrack error as a distance between the vehicle centerline and the tracking line at a reference distance forward of a front axle line defined as a line that would serve as a common rotational axis of the front wheels when the front wheels are straight; means for determining a rear crosstrack error as a distance between the vehicle centerline and the tracking line at a reference distance forward of a rear axle line defined as a line that would serve as a common rotational axis of the rear wheels when the rear wheels are straight; means for determining a center crosstrack error as a distance between the vehicle centerpoint and the tracking line; and means for steering wheels of the vehicle to minimize said errors.

14. The system of claim 13, wherein said reference distances are determined as a function of vehicle speed.

15. The system of claim 14, wherein said reference distances varied proportionally to the speed.

16. A method for guiding a land traveling container-handling vehicle from a remote land station along a curved path, the vehicle adapted for carrying at least one container, the method comprising the steps of:

providing at least two GPS receivers, each of the GPS receivers having an antenna mounted to the vehicle so that the antennae are spaced apart from each other;

defining a tracking line representing a desired travel direction at a current point along a desired land travel path that can include at least one curved portion, the tracking line intersecting a vehicle centerpoint;

receiving signals from GPS satellites using a first GPS antenna fixed at a first position on the vehicle;

receiving signals from GPS satellites using a second GPS antenna fixed at a second position on the vehicle that is spaced from the first GPS antenna in a horizontal direction;

detecting a position of the first GPS antenna;

detecting a position of the second GPS antenna;

determining a rotational error as an angular difference between a vehicle centerline and the tracking line, the vehicle centerline extending in a front-rear direction through a vehicle center, the vehicle centerline having a fixed relationship relative to vehicle and the first and second GPS antennae;

steering wheels of the vehicle to reduce the rotational error and to guide the vehicle along said land travel path.

17. The method of claim 16, further comprising:

determining a front crosstrack error as a distance between the vehicle centerline and the tracking line at a reference distance forward of a front axle line defined as a line that would serve as a common rotational axis of the front wheels when both front wheels are straight;

determining a rear crosstrack error as a distance between the vehicle centerline and the tracking line at a reference distance forward of a rear axle line defined as a line that would serve as a common rotational axis of the rear wheels when both rear wheels are straight; and determining a center crosstrack error as a distance between the vehicle centerline and the tracking line;

whereby said steering step also reduce at least one of said crosstrack errors.

18. The method of claim 17, further including determining said reference distances as function of vehicle speed.

19. The method of claim 16, further comprising the step of transmitting data representing the tracking line from a ground station to the vehicle.

20. The method of claim 16, further comprising:

measuring a fixed base position of a base GPS receiver;

providing a predetermined desired position of the vehicle; and calculating a correction vector that represents a difference between: (a) a current position as measured by the first and second GPS antennae relative to the fixed base position; and (b) the predetermined desired position relative to the fixed base position;

whereby the steering step further includes moving the vehicle by the correction vector.

21. The method of claim 16, wherein the desired travel path has a destination point where the container is to be delivered.

22. The method of claim 16, wherein the desired travel path has a destination point where the container is to be lifted.

23. A method for guiding a land traveling container-handling vehicle from a remote land station, the method comprising the steps of:

providing at least two GPS receivers, each of the GPS receivers having an antenna mounted to the vehicle so that the antennae are spaced apart from each other;

determining a position of each of the antennae of the respective GPS receivers;

determining an orientation of the vehicle based upon the relative positions of the GPS receivers; and steering wheels of the vehicle with respect to the orientation to guide the vehicle along a desired land travel path that can include at least one curved portion.

24. A guided vehicle system comprising:

a road-traveling container-handling vehicle having a rigid frame, the vehicle adapted for carrying at least one container;

at least two GPS receivers, each of the receivers having an antenna mounted to the frame so that the antennae are spaced from each other; and a controller for processing position data from the two GPS receivers, the controller operable to determine an orientation of the vehicle based upon the relative positions of the two GPS receivers and to steer the vehicle along a path that can include a curve portion.

25. The system of claim 24, further comprising:

a base station that is fixed relative to the ground;

a base GPS receiver having an antenna fixed to the base station;

means for determining a correction vector representing a difference between: (a) a current position as measured by the first and second GPS antennae relative to the fixed base position; and (b) the predetermined desired position relative to the fixed base position; and means for moving the vehicle by the correction vector.

26. The system of claim 24, further comprising a means for identifying a desired drive path.

27. The system of claim 24, further comprising a means for defining a tracking line representing a desired travel direction at a current point along a desired land travel path, the tracking line being tangent to the desired travel path at the current point, means for determining a rotational error as an angular difference between a vehicle centerline and the tracking line, the vehicle centerline extending in a front-rear direction relative to through a vehicle center, the vehicle centerline having a fixed relationship relative to vehicle and the first and second GPS antennae; means for determining a front crosstrack error as a distance between the vehicle centerline and the tracking line at a reference distance forward of a front axle line defined as a line that would serve as a common rotational axis of the front wheels when the front wheels are straight; means for determining a rear crosstrack error as a distance between the vehicle centerline and the tracking line at a reference distance forward of a rear axle line defined as a line that would serve as a common rotational axis of the rear wheels when the rear wheels are straight; means for determining a center crosstrack error as a distance between the vehicle centerpoint and the tracking line; and means for steering wheels of the vehicle to minimize said errors.

28. The method of claim 27, whereby said reference distance varies proportionally to the speed.

29. The system of claim 27, wherein said reference distances are determined as a function of vehicle speed.

30. The system of claim 29, wherein said reference distances varied proportionally to the speed.

* * * * *